US005155894A

United States Patent [19]

Burden

[11] Patent Number: 5,155,894

[45] Date of Patent: Oct. 20, 1992

[54] METHOD OF REPAIRING BY LINING HEAT EXCHANGER TUBES

[75] Inventor: Paul Burden, Oxford, England

[73] Assignee: NNC Limited, England

[21] Appl. No.: 575,299

[22] Filed: Aug. 30, 1990

[30] Foreign Application Priority Data

Sep. 8, 1989 [GB] United Kingdom ..... 8920382

[51] Int. Cl.[5] ..... B23P 15/26

[52] U.S. Cl. ..... 29/890.031; 29/402.16; 29/523

[58] Field of Search ..... 29/890.031, 402.16, 29/523, 428, 527.4, 726, 727; 165/76; 228/183, 119; 138/97

[56] References Cited

U.S. PATENT DOCUMENTS

| | | | |
|---|---|---|---|
| 4,811,759 | 3/1989 | Billoue | 138/89 |
| 4,922,605 | 5/1990 | Cartry et al. | 29/727 |
| 4,937,933 | 7/1990 | Dietrich | 29/890.031 |
| 4,960,650 | 10/1990 | Vigneron et al. | 428/594 |

FOREIGN PATENT DOCUMENTS

| | | | |
|---|---|---|---|
| 0132950 | 2/1985 | European Pat. Off. | 29/840.031 |
| 0263733 | 4/1988 | European Pat. Off. . | |
| 0271739 | 6/1988 | European Pat. Off. . | |
| 351140 | 4/1922 | Fed. Rep. of Germany . | |
| 0137153 | 10/1979 | Japan | 29/890.031 |
| 788505 | 1/1958 | United Kingdom . | |
| 1591659 | 6/1981 | United Kingdom . | |

OTHER PUBLICATIONS

Patent Abstracts of Japan, vol. 12, No. 464 (M-771)(3311), Dec. 6, 1988.

*Primary Examiner*—Irene Cuda

*Attorney, Agent, or Firm*—Kirschstein, Ottinger, Israel & Schiffmiller

[57] ABSTRACT

A method of repairing a defective tube in a heat exchanger of the tube-in-shell type comprises inserting a tubular sleeve into the defective tube and extending through the tube from one tubeplate to the other, and bonding the sleeve to each tubeplate. The extremities of the sleeve are preferably welded to the outer surface of the respective tubeplate. In repairing a defective tube which has one end which is bonded to a tubular tubeplate boss having a bore which is of larger diameter than the external diameter of the tube, the diameter of a poriton of the sleeve is preferably expanded to fit the bore of the tubeplate boss after insertion of the sleeve into the tube.

7 Claims, 1 Drawing Sheet

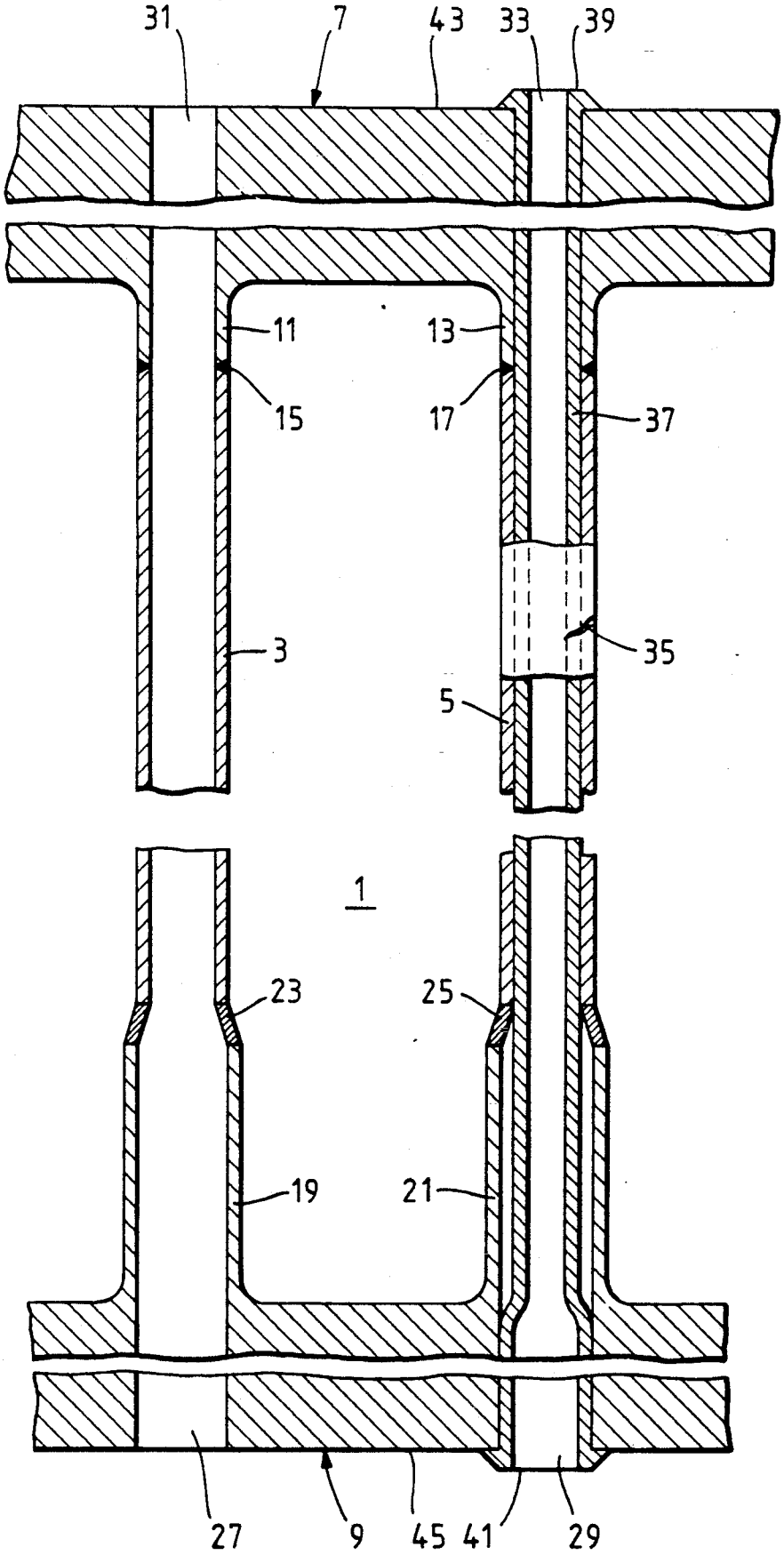
31
7
43
33
39
11
13
15
17
37
3
35
5
1
23
25
19
21
27
9
45
41
29

METHOD OF REPAIRING BY LINING HEAT EXCHANGER TUBES

BACKGROUND OF THE INVENTION

1. Field of the Invention

This invention relates to heat exchangers, and particularly to a method of repairing a defective tube in a tube-in-shell heat exchanger, such as a steam generator unit (SGU) of a nuclear reactor.

2. Description of Related Art

A heat exchanger of the tube-in-shell type comprises a shell in which are mounted spaced-apart substantially parallel tubeplates having apertures into which open-ended tubes are welded, so that a bundle of substantially parallel tubes extends between the tubeplates. A first fluid, such as liquid sodium, passes through the shell, in contact with the outside surfaces of the tubes, and a second fluid, such as water, flows through the tubes, so that heat is transferred from one fluid to the other.

In operation of such a heat-exchanger, a leak may develop in a tube. In the case of a liquid sodium cooled reactor, this will allow sodium and steam to mix and to produce a chemical reaction. Neighbouring tubes may be weakened or ruptured by this reaction.

The conventional method of bringing an SGU back into operation following a tube leak is to plug that tube and, for example, at least the neighbouring six tubes, so that all of those tubes become inoperative. This obviously results in a decrease in efficiency of the heat exchanger. Furthermore, because heat is not being extracted from the coolant in the region of the plugged tubes, a hot spot is created in the tube bundle, which can cause stressing of further tubes around the plugged tubes. It will be apparent that only a limited number of leaking tubes and their neighbouring tubes can be plugged before the number of inoperative tubes becomes too large for the SGU to continue to operate.

An alternative method of dealing with leaking tubes, which does not involve plugging, is disclosed in our European Patent No: 0132950. In that method, a short sleeve is inserted into a defective tube through one tubeplate and is explosively welded to that tubeplate and to the inner surface of the tube so that the defect is bridged by the sleeve. This reduces the flow area of the tube, but allows it to remain operative and still contributing to the heat exchange function. Since any hot spots created around these tubes due to the reduced flow will be substantially cooler than if the tubes were plugged, more leaking tubes can be repaired before the SGU has to be finally taken out of service.

However, that method has certain disadvantages. Firstly, the method involves welding on to the tube surface, which might impair the strength of the tube. Secondly, the method is primarily intended for bridging a leaking wed between the tube and the tubeplate, and is less applicable to the bridging of a leak in the wall of the tube itself.

SUMMARY OF THE INVENTION

It is an object of the present invention to provide an improved method of repairing a defective heat exchanger tube.

According to the invention there is provided a method of repairing a defective tube in a heat exchanger of the tube-in-shell type, comprising inserting a tubular sleeve into the defective tube and extending through the tube from one tubeplate to the other; and bonding the sleeve to each tubeplate.

The sleeve is preferably formed of the same material as the tube.

The sleeve is preferably bonded to each tubeplate by welding, and preferably the extremities of the sleeve are welded to the outer surface of the respective tubeplate.

BRIEF DESCRIPTION OF THE DRAWING

An embodiment of the invention will now be described, by way of example, with reference to the accompanying drawing, which is a schematic cross sectional view of part of a tube bundle in a tube-in-shell heat exchanger.

DETAILED DESCRIPTION OF THE PREFERRED EMBODIMENT

Referring to the drawing, a tube bundle 1 comprises a number of vertical tubes, such as the tubes 3, 5, extending between horizontal tubeplates 7,9. The tubeplate 7 has integral tubular bosses 11,13 to which the tubes 3,5 are welded at weld areas 15, 17. The tubeplate 9 has integral tubular bosses 19,21 the bore of which is slightly larger than the outer diameter of the tubes 3,5, so that the tubes can be readily inserted through the bosses 19,21 during assembly. The lower end of each tube is welded to its respective boss 19,21 at weld areas 23,25. Water enters the tubes 3,5 via tubeplate apertures 27,29 and passes upwards through the tubes where it is heated by heat transferred from liquid sodium which fills the space around the tubes and between the tubeplates. Steam is thereby generated, and leaves the tubes at their upper ends 31,33.

Let us assume that a split 35 has occurred in the wall of the tube 5. In order to bridge the split, a sleeve 37 is inserted into the bore of the faulty tube 5, the sleeve extending over the full length of the tube, so that its ends 39,41 are level with, or stand just proud of, the outer surface 43,45 of the respective tubeplate. The lower end of the sleeve is expanded to fit the bore of the tubeplate aperture 29. The ends 39,41 of the sleeve 37 are welded to the respective tubeplates 7,9 at the outer surfaces 43,45 thereof. The sleeve is thereby sealed to each tubeplate.

The sleeve 37 is preferably formed of the same material as the tube 5. The wall thickness of the sleeve is determined by the creep strength required during the remainder of the expected life of the SGU. Hence, a repair effected late in the life of the SGU can use a slightly thinner-walled sleeve than one effected earlier, and can therefore provide more efficient heat transfer. The outer diameter of the sleeve 37 is chosen to give a minimal gap between the outer surface of the sleeve and the inner surface of the faulty tube 5, but sufficient to allow smooth insertion of the sleeve. The inner surface of the tube 5 is preferably cleaned with acid, to remove some corrosion, before the sleeve is inserted.

The sleeve can be inserted while the SGU is still in situ.

The present invention has advantages over the method described in our above-mentioned European patent. Due to the use of a full-length repair sleeve in the faulty tube, it is totally immaterial where the fault has occurred; it may be at the tube/tubeplate boss weld area or it may be anywhere along the length of the tube. Furthermore, more than one fault in a tube can be bridged by a single sleeve. Since the welding of the sleeve is effected at the tubeplates, no welding to the tube wall is required. Furthermore, the welding positions are both very accessible. The welding may be effected by any suitable method, or other bonding methods might be acceptable.

The invention therefore provides a repair method which is simple, is applicable to all kinds and positions of tube leaks and is of high integrity. The tube after repair should be still capable of operating under sustained full load conditions.

The method is suitable for use in repairing other heat exchangers of the tube-in-shell type, besides those used in liquid sodium cooled nuclear reactors.

I claim:

1. A method of repairing a defective tube through which a fluid flows in operation of a heat exchanger of the tube-in-shell type, comprising the steps of: providing a hollow tubular sleeve with opposite open ends, and an interior open passage extending between the open ends; inserting the sleeve into the defective tube and extending the sleeve through the tube from one tubeplate to the other to allow the fluid to flow freely along the open passage between the tubeplates; and bonding the respective open ends of the sleeve to each tubeplate.

2. A method as claimed in claim 1, further comprising the step of forming said sleeve of the same material as said defective tube.

3. A method as claimed in claim 1, wherein said bonding step is performed by welding.

4. A method as claimed in claim 3, wherein the welding step is performed by welding the ends of said sleeve to an outer surface of said respective tubeplate.

5. A method as claimed in claim 1, further comprising the step of selecting the outer diameter of said sleeve to give minimal clearance from the inner surface of said defective tube, while allowing smooth insertion of said sleeve into said tube.

6. A method as claimed in claim 1, further comprising the step of selecting the thickness of the sleeve wall to give a required creep strength over the remainder of the expected life of the heat exchanger.

7. A method as claimed in claim 1 for use in repairing a defective tube having one end which is bonded to a tubular tubeplate boss having a bore which is of larger diameter than the external diameter of said tube, further comprising the step of expanding the diameter of a portion of said sleeve to fit the bore of said tubeplate boss after insertion of said sleeve into said tube.

* * * * *